US009126209B2

(12) United States Patent
Wolfgram et al.

(10) Patent No.: US 9,126,209 B2
(45) Date of Patent: Sep. 8, 2015

(54) FLUID SPRAYER ATTACHMENT

(75) Inventors: Robert R. Wolfgram, Watertown, WI (US); Brian R. Olsson, Menomonee Falls, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 780 days.

(21) Appl. No.: 13/368,513

(22) Filed: Feb. 8, 2012

(65) Prior Publication Data

US 2013/0200173 A1 Aug. 8, 2013

(51) Int. Cl.

| | |
|---|---|
| ***B05B 7/30*** | (2006.01) |
| ***B05B 9/00*** | (2006.01) |
| ***B05B 7/24*** | (2006.01) |
| ***B05B 15/06*** | (2006.01) |
| ***B05B 1/02*** | (2006.01) |
| ***B05B 1/12*** | (2006.01) |
| ***B05B 9/01*** | (2006.01) |

(52) U.S. Cl.

CPC . *B05B 9/007* (2013.01); *B05B 1/02* (2013.01); *B05B 1/12* (2013.01); *B05B 7/2443* (2013.01); *B05B 9/01* (2013.01); *B05B 15/065* (2013.01)

(58) Field of Classification Search

CPC ..... B05B 7/2443; B05B 15/065; B05B 1/02; B05B 1/12; B05B 9/007; B65D 83/7532

USPC ..... 239/310, 312, 318, 397, 442, 600, 601

See application file for complete search history.

(56) References Cited

U.S. PATENT DOCUMENTS

| | | | | |
|---|---|---|---|---|
| 5,085,278 | A * | 2/1992 | Keltner | 169/15 |
| 5,529,460 | A | 6/1996 | Eihusen et al. | |
| 6,685,107 | B1 | 2/2004 | Salzman | |
| 7,083,120 | B2 * | 8/2006 | Gilpatrick et al. | 239/397 |

* cited by examiner

*Primary Examiner* — Christopher Kim

(74) *Attorney, Agent, or Firm* — Rathe Lindenbaum LLP

(57) ABSTRACT

An attachment for a fluid sprayer comprises a main flow passage, a quick disconnect portion that facilitates connection of the attachment to a first flow constrictor providing flow at a first pressure and a second flow constrictor between the main flow passage and the quick disconnect portion. The second flow constrictor provides flow at a second pressure less than the first pressure.

17 Claims, 6 Drawing Sheets

FLUID SPRAYER ATTACHMENT

BACKGROUND

Fluid sprayers, sometimes referred to as pressure washers, are utilized to deliver liquid at one or more pressures and in one or more spray patterns for various applications. To provide the different pressures and spray patterns, multiple different nozzles must be removed and replaced. This current practice is tedious and time-consuming and requires a separate nozzle attachment for each and every different pressure and/or spray pattern. As the number of nozzle attachments increases, so does the cost of the pressure washer as well as the likelihood that one or more of the nozzle attachments may become lost or misplaced.

DETAILED DESCRIPTION OF THE EXAMPLE EMBODIMENTS

Figure 1:
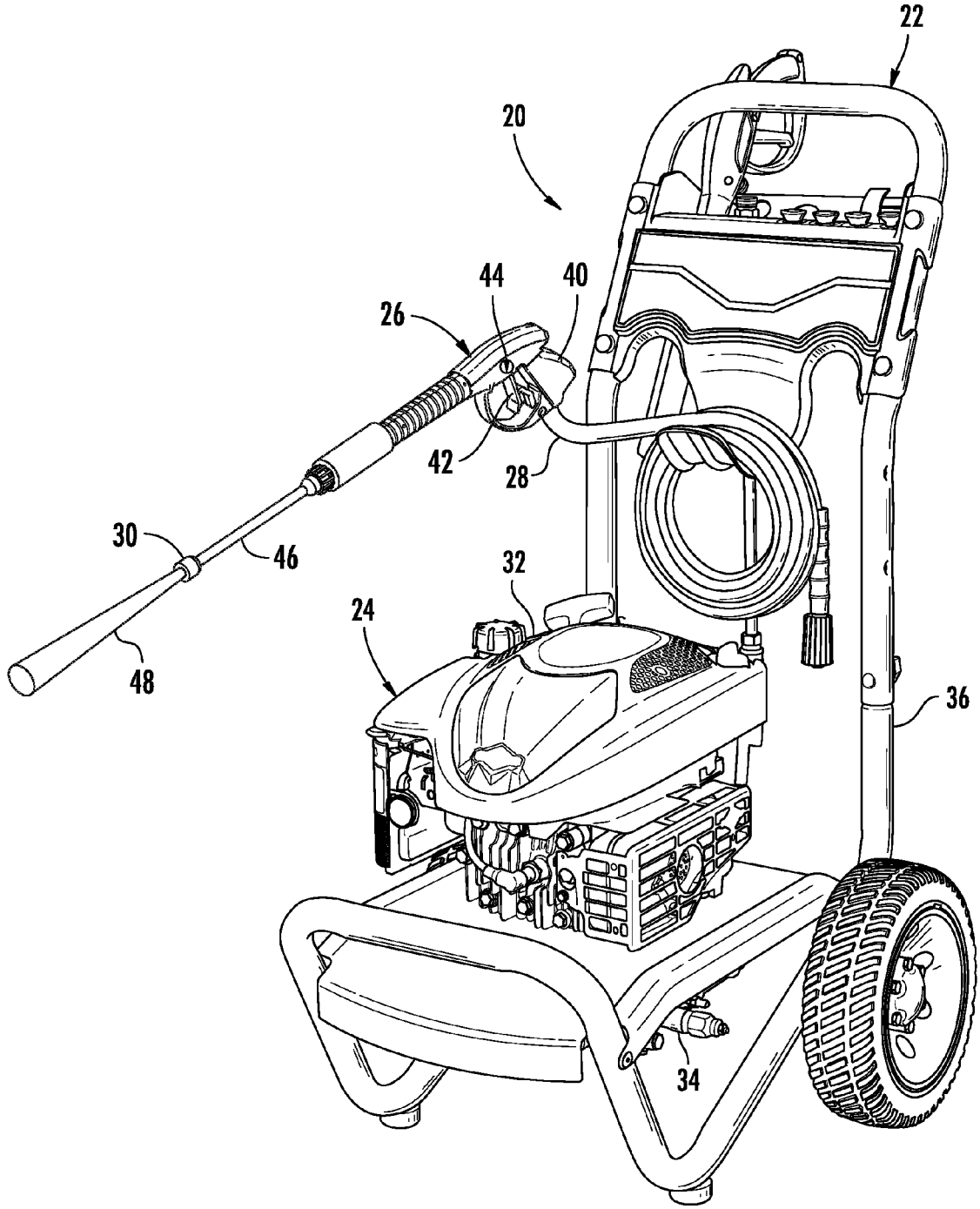
FIG. 1 is a perspective view of one example of a fluid sprayer.

FIG. 1 illustrates one example of a fluid sprayer 20. Fluid sprayer 20 delivers fluid, including liquid, at a selected pressure and a selected spray pattern. As will be described hereafter, fluid sprayer 20 includes an attachment 30 that facilitates changing of the pressure or the spray pattern of the liquid with fewer nozzle attachments or parts.

Fluid sprayer 20 comprises a source 24 of pressurized fluid, an emitting wand or spray gun 26 connected to source 24 by one or more hoses 28 and attachment 30. Pressurized fluid source 24 pressurizes fluid (liquid, gas or a combination thereof) and supplies a fluid to spray gun 26 which directs pressurized fluid through attachment 30. In one implementation, pressurized fluid source 24 delivers fluid set to have a pressure at a discharge point at attachment 30 of at least 100 pounds per square inch (PSI) (at least a Type 1 power washer).

In the example illustrated, pressurized fluid source 24 comprises an internal combustion engine 32 which drives a fluid pump 34 to pressurize water (and potentially additional additives). According to one embodiment, the pump 34 comprises a pump at least similar to the pump shown and described in U.S. Pat. No. 6,092,998 to Dexter et al. which issued on Jul. 25, 2000, the full disclosure of which is hereby incorporated by reference. The internal combustion engine 32 and the pump 34 are supported by a stand 36.

In other embodiments, the internal combustion engine 32, the pump 34 and the stand 36 may have other configurations. In yet other embodiments, pressurized fluid source 24 may have other configurations and may deliver pressurized fluid at other pressures. In some implementations, pressurized fluid source 24 may not comprise a portable source such as shown in FIG. 1, but may be stationary or part of a larger structure.

Spray gun 26 is fluidly connected to pump 34 by hose 30 and receive pressurized fluid from pump 34. Spray gun 26 comprises handle 40, trigger 42, valve 44 and barrel 46. Handle 40 facilities gripping of spray gun 26. Trigger 42 comprises a manually actuatable trigger operatively connected or operably coupled to valve 44 to selectively open and close valve 44. Valve 44, schematically shown, actuates between a fully closed state and a fully open state in response to depressment, pivoting or other actuation of trigger 44. Valve 44 regulates the flow of the pressurized fluid to barrel 46. Barrel 46 delivers the pressurized fluid to attachment 30.

In other implementations, spray gun or wand 126 may have other configurations. For example, in some implementations, spray gun or wand 26 may omit trigger 42 and may simply comprise a wand for directing or aiming the pressurized fluid, wherein other means are provided for controlling the supply of pressurized fluid. In some implementations, spray gun or wand may be stationary or fixed rather than being movable relative to source 24 via the length and flexibility of hose 28.

Attachment 30 is coupled to an end of barrel 46 such that fluid directed through barrel 46 further flows through attachment 30. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members. The term "fluidly coupled" shall mean that two are more fluid transmitting volumes are connected directly to one another or are connected to one another by intermediate volumes or spaces such that fluid may flow from one volume into the other volume.

Figure 2:
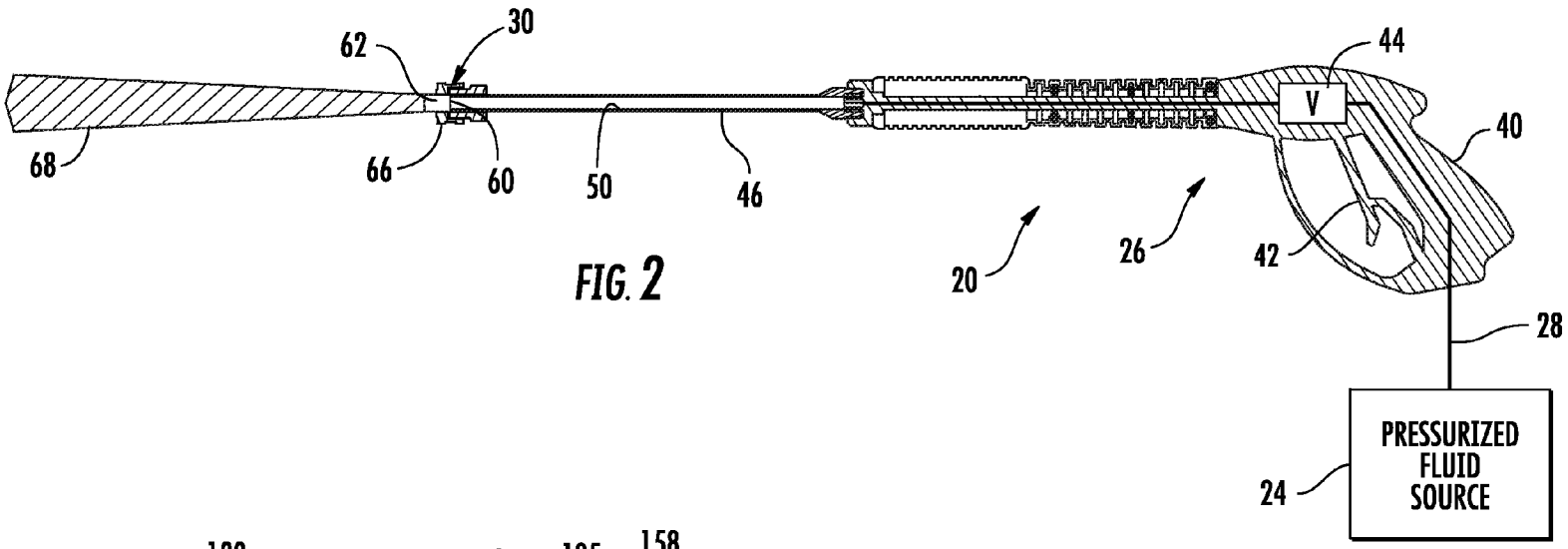
FIG. 2 is a side elevational view of the fluid sprayer FIG. 1 with portions shown in section and with portions shown schematically.

FIG. 2 illustrates fluid sprayer 20 in more detail. FIG. 2 is a sectional view of spray gun 26 with pressurized fluid source 24 and hose 28 being schematically illustrated. As shown by FIG. 2, spray gun 26 directs pressurized fluid received from source 24 via post 28 through valve 44 and barrel passage 50 of barrel 46 to attachment 30. In one implementation, attachment 30 is removably mounted to the end of barrel 46. In another implementation, attachment 30 is permanently or fixedly mounted to the end of barrel 46 or at least partially integrally formed as part of a unit single unitary body with the end of barrel 60.

Attachment 30 includes a flow passage 60, a flow constrictor 62 across flow passage 60 and a quick disconnect portion 66. Flow constrictor 62 extends between the end of barrel 60 and quick disconnect portion 66. Flow constrictor 62 causes fluid 68 to have a predetermined first spray pattern with first pressure characteristics that are distinct from the pressure characteristics of the fluid flow through barrel 46. At the same time, quick disconnect 66 facilitates the addition of other supplemental attachments to the end of wand or spray gun 26 to further modify the first spray pattern and the first pressure characteristics to provide a second spray pattern with second pressure characteristics.

In one implementation, the flow constrictor provided by attachment 30 causes fluid flow 48 from attachment 30 to have a pressure characteristic greater than the pressure characteristic of the fluid within barrel 46 and less than the corresponding pressure characteristic of fluid flow from the supplemental attachment to which attachment 30 is configured to be releasably connected. In such an implementation, the pressure characteristic of fluid flow from a first stage of the barrel 46, from a second stage of the attachment 30 and ultimately from a third stage of a supplemental attachment that may be attached to attachment 30 is increased at each stage. Due to this stepwise or stage wise progression of increased pressures, the flow constrictor provided by attachment 30 does not impair or minimally impairs the concurrent use of attachment 30 to releasably mount a supplemental attachment providing a different flow pressure or flow pattern without having to remove and replace attachment 30 with the supplemental attachment.

Figure 4:
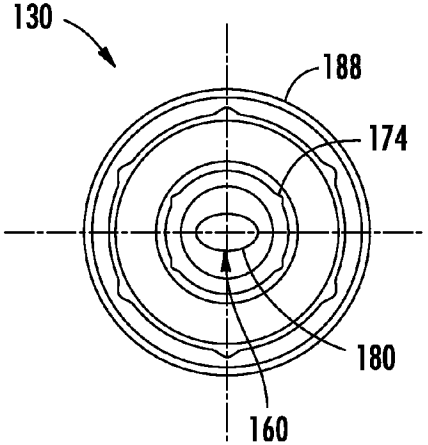
FIG. 4 is an elevational view of the attachment of FIG. 3 taken along line 3-3.
Figure 3:
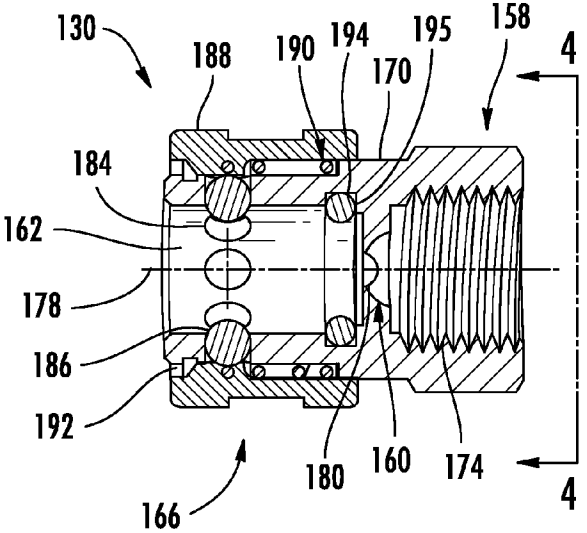
FIG. 3 is a sectional view of an example attachment of the fluid sprayer of FIG. 2.
Figure 5:
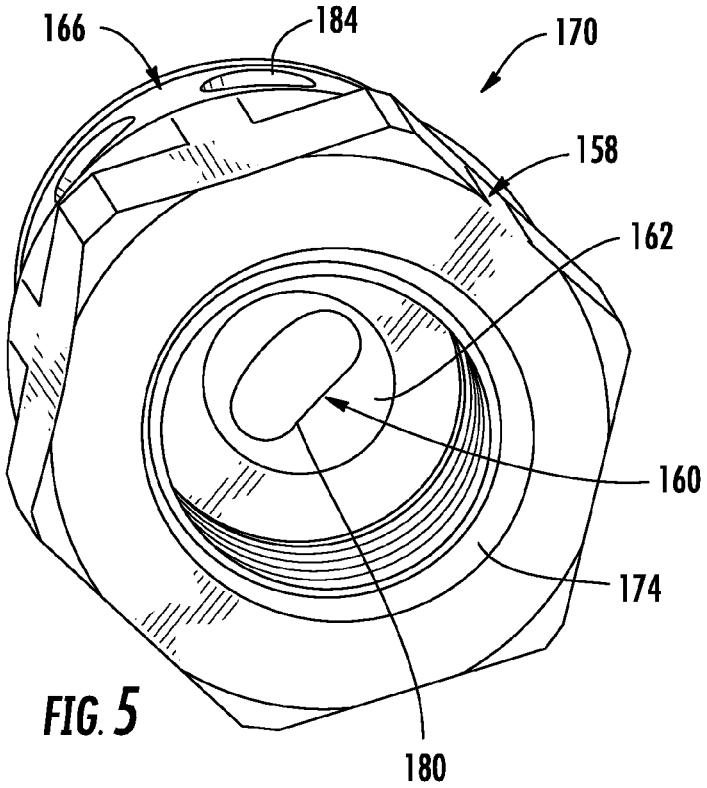
FIG. 5 is a rear perspective view of an example tubular member of the attachment of FIG. 3.
Figure 6:
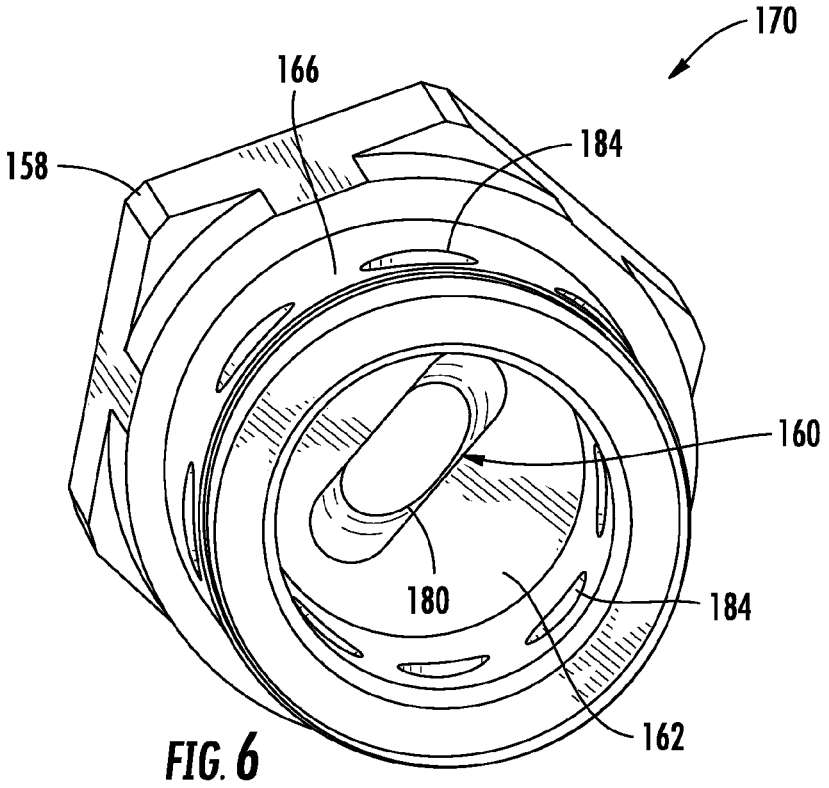
FIG. 6 is a front perspective view of the tubular member of FIG. 5.
Figure 7:
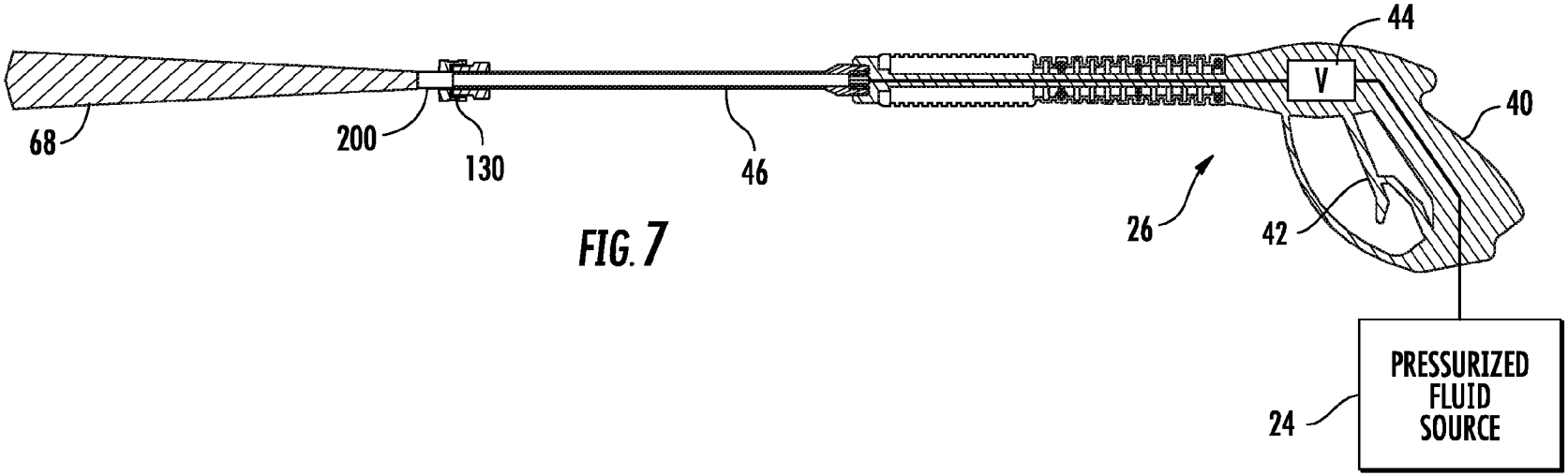
FIG. 7 is a side elevational view of the fluid sprayer FIG. 1 with a supplemental attachment, with portions shown in section and with portions shown schematically.
Figure 9:
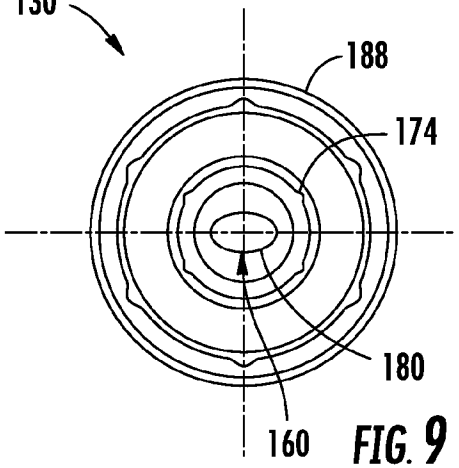
FIG. 9 is an elevational view of the attachments of FIG. 8 taken along line 9-9.

FIGS. 3 and 4 illustrate attachment 130, one example of attachment 30. As shown by FIGS. 3 and 4, attachment 130 is a single assembled piece configured to be mounted to an end of barrel 46 of gun or wand 126 and configured such that attachment 30 remains as a single assembled or interconnected piece prior to being mounted to barrel 46 or after being removed from barrel 46. Attachment 130 generally comprises mounting portion 158, flow constrictor 160 and quick disconnect portion 166. Each of mounting portion 158, flow constrictor 160 and quick disconnect portion 166 are partially formed from a single tubular member 170 which is integrally formed as a single unitary homogenous body. FIGS. 5 and 6 are perspective views of tubular member 170 from opposite ends of tubular member 170.

In the implementation illustrated, tubular member 170 is formed from a metal, such as brass or steel. In other implementations tubular member 170 may be formed from other materials, maybe formed from multiple different materials that are co-molded or maybe formed from multiple sections which are welded or otherwise permanently bonded to one another. Tubular member 170 serves as a base structure facilitating the provision of attachment 130 as a single assembled piece to reduce part count.

Mounting portion 158 facilitates mounting of attachment 130, sometimes referred to as a fitment, to and end of barrel 46 (shown in FIG. 2). In the example illustrated, mounting portion 158 comprises internal threads 174 which facilitate threaded securement of attachment 130 on the end of barrel 46. In other implementations, mounting portion 158 may include other mechanisms to facilitate mounting of attachment 130 onto the end of barrel 46.

Flow constrictor 160 comprises a flow constriction provided by tubular member 170 and across the passage 162 which extends through tubular member 170. Flow constrictor 160 comprises at least one opening asymmetric with respect to a centerline 178 of tubular member 170 and of passage 162. In the implementation illustrated, flow constrictor 160 comprises an orifice 180 as a shape asymmetric with respect to centerline 178. In the example illustrated, orifice 180 has an oval shape to provide a fanned spray pattern. As a result, orifice 180 serves as a soaper nozzle. In other implementations, orifice 180 may have other asymmetric shapes depending upon the desired spray pattern. For example, orifice 180 may alternatively have an elongated rectangular shape or an elongated diamond shape. In still other implementations, flow constrictor 160 may comprise a plurality of spaced openings which constrict the flow of fluid and which provide a desired flow pressure and spray pattern. In yet other implementations, flow constrictor 160 may comprise an insert removably or permanently inserted into and captured within a tubular member 170 between mounting portion 158 and quick disconnect portion 166. Although flow constrictor 160 is illustrated as being located to one side of quick disconnect portion 166, in other implementations, flow constrictor 160 may alternatively be formed in other portions of tubular member 170 so as to be between mounting portion 158 or passage 162 and a flow constrictor provided by a supplemental attachment connected to attachment 130 by quick disconnect portion 166. For example, flow constrictor 160 may alternatively be located so as to partially overlap quick disconnect portion 166 or so as to be within or to the other side of quick disconnect portion 166.

Quick disconnect portion 166 comprises a portion of attachment 130 that is configured to be releasably attached, without fasteners and without tools, to a supplemental attachment, such as a nozzle attachment having a different flow constrictor as compared to flow constrictor 160. In the implementation illustrated, quick disconnect portion 166 comprises openings 184, balls 186, collar 188, spring 190 retainer 192 and O-ring 194. Openings 184 comprise a series of circumferentially arranged openings in tubular member 170. Balls 186 comprise a plurality of balls within openings 184. Openings 184 are sized to allow balls 186 to pass only partially through openings 186.

Collar 188 comprises a sleeve encircling tubular member 170 and slidable along tubular member 170 between a releasing positioned and a retaining position. In the releasing positioned, collar 188 is either removed from balls 186 or in which one or more of detents on an inner surface of collar 188 are aligned with balls 186 to permit balls 186 to move radially outward away from centerline 178. In the retaining position, collar 188 engages balls 186 and retained balls 186 against the bottom of openings 186 and sufficiently projecting into passage 162 interact with a corresponding detent or groove in a supplemental attachment.

Spring 190 comprises a compression spring encircling tubular member 170 while being captured between tubular member 170 and collar 188. Spring 190 resiliently biases collar 188 towards the retaining position. In some implementations, spring 190 may be omitted. Retainer 192 comprises a clip or other member secured to tubular member 170 and configured to retain collar 188 upon tubular member 170. In some implementations, retainer 192 may be provided by a structure integrally formed as part of tubular member 170. O-ring 194 is received and captured within an inner circumferential groove 195 within tubular member 170. O-ring 194 provided a seal against and inserted supplemental attachment about passage 162. In other implementations, quick disconnect portion 166 may have other configurations that is configured to be releasably attached, without fasteners and without tools, to a supplemental attachment.

Figure 8:
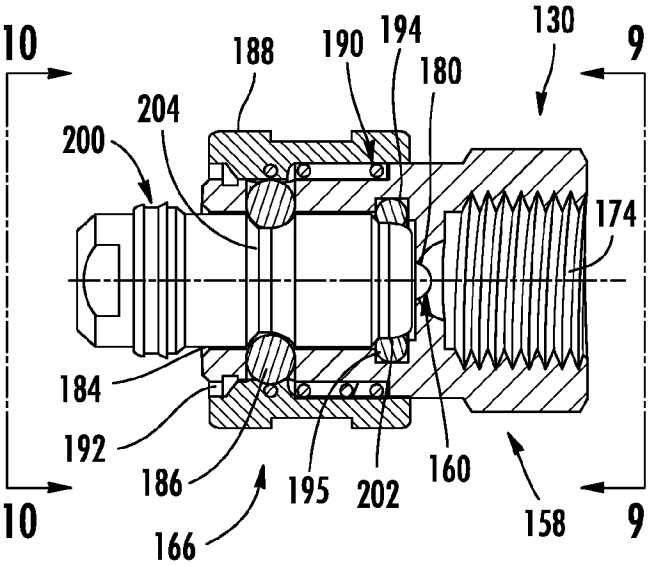
FIG. 8 is a sectional view of an example attachment and an example supplemental attachment of the fluid sprayer of FIG. 7.
Figure 10:
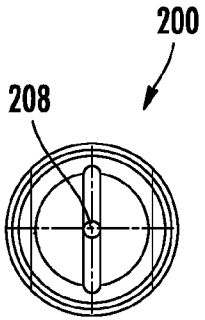
FIG. 10 is an elevational view of the attachments of FIG. 8 taken along line 10-10.

FIGS. 7-10 illustrate fluid sprayer 20 including attachment 130 and releasably connected to a supplemental attachment 200 by quick disconnect portion 166 of attachment 130. In the example illustrated, supplemental attachment 200 comprises a high pressure nozzle. Supplemental attachment 200 includes meeting end 202, groove 204 and spray nozzle opening 208 (shown in FIG. 10). As shown by FIG. 8, when inserted into attachment 130, mating end 202 becomes sealed against O-ring 194. Groove 204 comprises a surface or groove on an outer circumferential surface of attachment 200. Groove 204 receives balls 186 when attachment 200 is inserted into attachment 130 to retain attachment 200 with respect to attachment 130.

Spray nozzle opening 208 comprises a flow constrictor through which fluid is ejected or sprayed. In the implementation illustrated, spray nozzle 208 has a spray pattern different than that of constrictor 160 and/or has pressure characteristics different than that of the fluid exiting constrictor 160. In the example, spray nozzle 208 is configured such that fluid is ejected through sprayer nozzle 208 at a higher pressure as compared to fluid passing through constrictor 160. In other implementations, spray nozzle 208 may have other configurations. In other implementations, supplemental attachment 200 may have other configurations depending upon the desired spray pattern, the desired pressure characteristics and the configuration of quick disconnect portion 166 of attachment 130.

Figure 11:
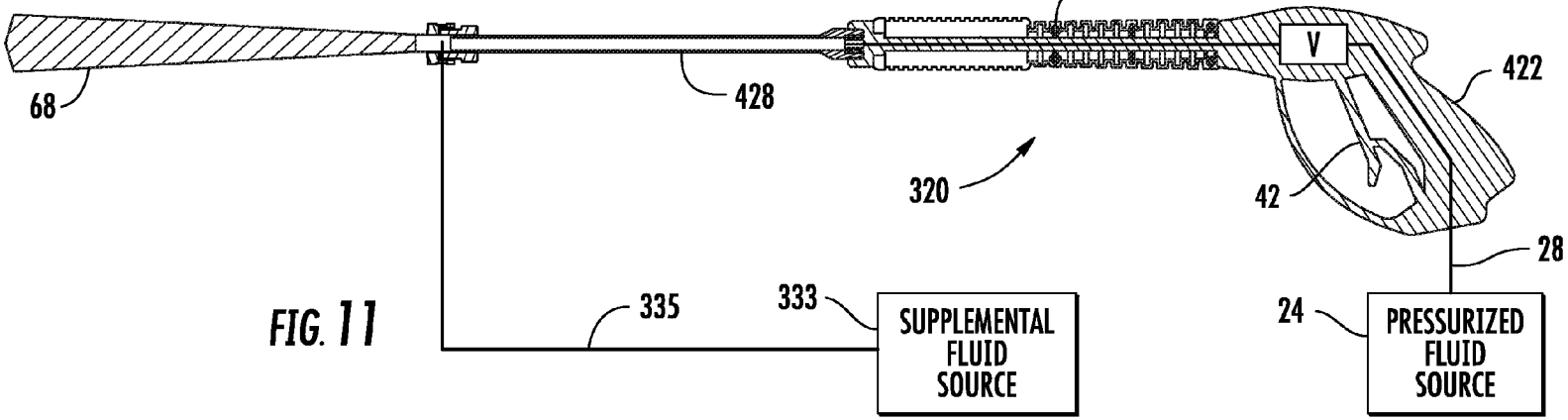
FIG. 11 is a side elevational view of another implementation of the fluid sprayer FIG. 1 with portions shown in section and with portions shown schematically.

FIG. 11 illustrates fluid sprayer 320, another implementation of fluid sprayer 20. Fluid sprayer 320 is similar to fluid sprayer 20 except that fluid sprayer 320 includes attachment 330 which facilitates the addition of supplemental fluid from a supplemental fluid source 333 via conduit 335 (both of which are schematically shown) to the pressurized fluid being supplied by pressurized fluid source 24 at a location downstream of hose 28. Those remaining components of fluid sprayer 320 which correspond to components of fluid sprayer 20 are numbered similarly.

Figure 12:
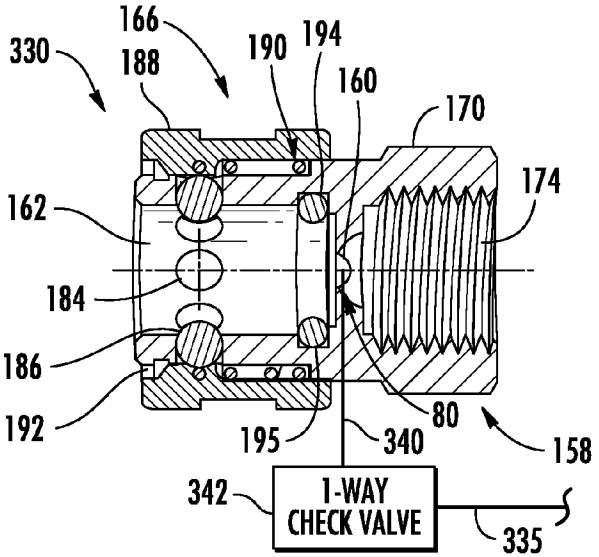
FIG. 12 is a sectional view of an example attachment of the fluid sprayer of FIG. 11.

As shown by FIG. 12, attachment 330 is similar to attachment 130 except that attachment 330 additionally comprises injection port 340 and a one way check valve 342, both of which are schematically illustrated. Injection port 340 comprises a conduit extending through tubular body 170 and fluidly coupled to passage 162. In the implementation illustrated, injection port 340 is fluidly coupled to passage 162 such that supplemental fluid supplied through conduit 335 is drawn into the fluid stream flowing through passage 162 at a desired rate. In the implementation illustrated, injection port 340 opens into passage 162 proximate to flow constrictor 160. As a result, flow constrictor 160 serves as a venturi drawing the supplemental fluid into the fluid stream at an elevated rate.

One way check valve 342 comprises an automatic check valve fluidly coupled between conduit 335 and injection port 340. One way check valve 342 is configured to fluidly connect conduit 335 to injection port 340, automatically, in response to a predefined pressure differential. In the implementation illustrated, check valve 342 is configured to fluidly connect conduit 335 and injection port 340 in response to pressure differentials created by a fluid stream flowing through the venturi provided by constrictor 160 when a supplemental attachment, such as supplemental attachment 200 shown in FIG. 8, is not attached to attach 130 such that fluid is directly discharged and sprayed from attachment 130. Check valve 342 is configured to fluidly occlude, disconnect or close conduit 335 and injection port 340, automatically, in response to an insufficient flow of fluid through or across constrictor 160 or in response to fluid being backed up downstream of constrictor 160, resulting in a lower pressure differential, such as when a supplemental attachment 200 is connected to attachment 330.

In the implementation illustrated, check valve 342 is provided as part of attachment 330, formed upon or within tubular member 170. In other implementations, check valve 342 may be provided in other locations on attachment 330. In yet other implementations, check valve 342 may alternatively be supported at other locations, such as being severally mounted to conduit 335 or another proximate structure.

Figure 13:
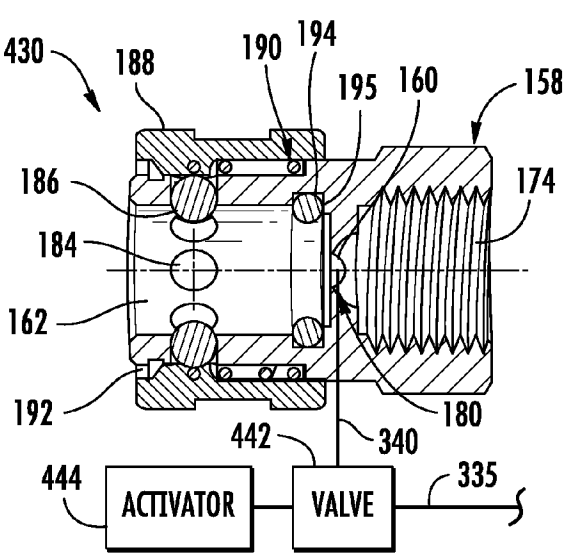
FIG. 13 is a sectional view of another example attachment of the fluid sprayer of FIG. 11.

FIG. 13 illustrates attachment 430, another implementation of attachment 330. Attachment 430 is similar to attachment 330 except that attachment 430 replaces one way check valve 342 with valve 442 and actuator 444. Valve 442 comprises a valve that is configured to be selectively actuated between an open state and a closed state by actuator 444. In the open state, valve 442 fluidly couples conduit 335 to injection port 340. In a closed state, valve 1442 occludes, closes or blocks the fluid connection between conduit 335 and injection port 340.

Actuator 444 comprises a mechanism configured to open and close valve 442. In one implementation, actuator 444 comprise a manual actuator configured to be manually moved such that valve 442 is opened or manually closed. In one example, actuator 442 may comprise a manual actuator such as a knob. In another implementation, actuator 444 may comprise a powered actuator such as a hydraulic or pneumatic cylinder assembly, and electric solenoid or the like, which upon receiving control signals from a controller associated with gun 26, actuates valve 442 between the open position of a closed position.

Figure 14:
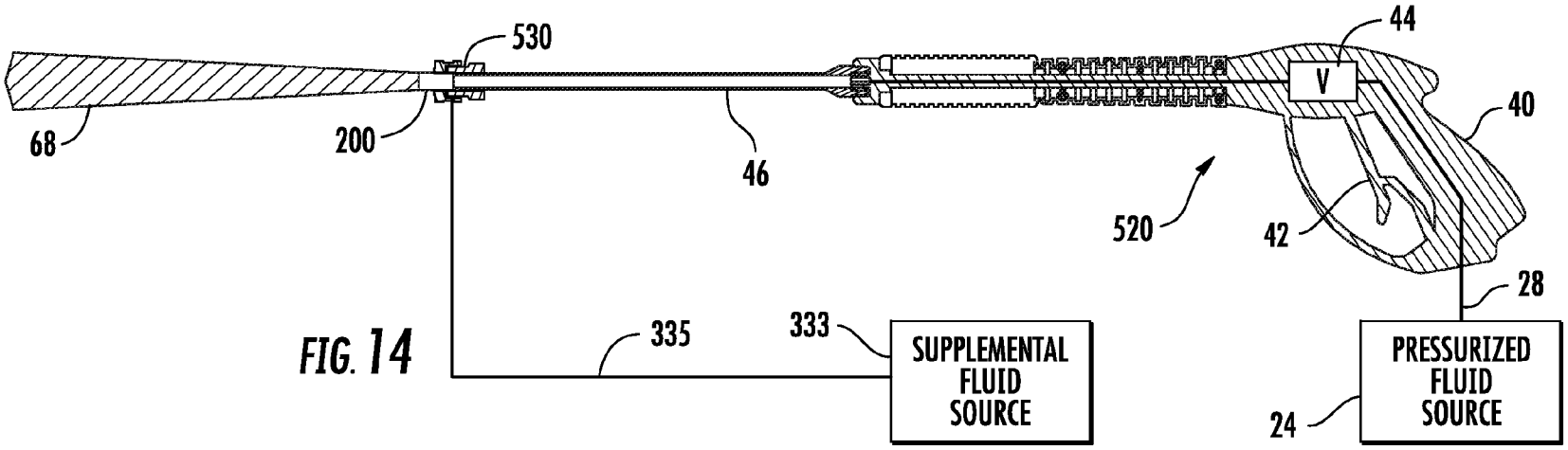
FIG. 14 is a side elevational view of another implementation of the fluid sprayer FIG. 1 with portions shown in section and with portions shown schematically.
Figure 15:
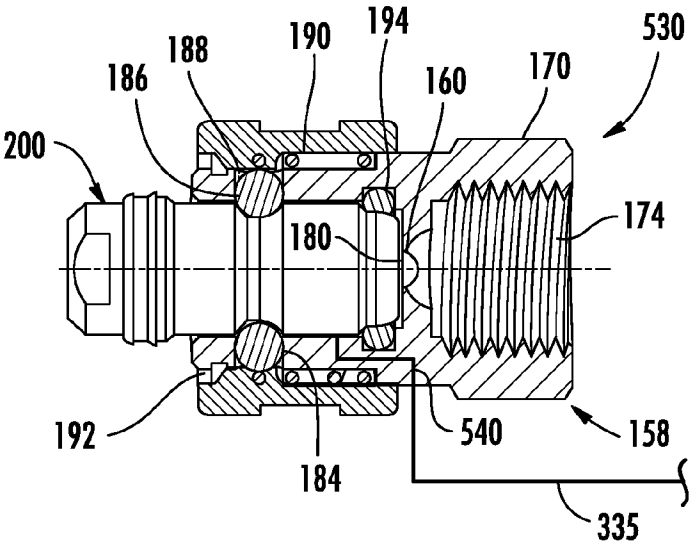
FIG. 15 is a sectional view of an example attachment of the fluid sprayer of FIG. 14.

FIGS. 14 and 15 illustrate fluid sprayer 520, another implementation of fluid sprayer 20, with supplemental attachment 200. Fluid sprayer 520 is similar to fluid sprayer 20 except that fluid sprayer 320 includes attachment 530 which facilitates the addition of supplemental fluid from a supplemental fluid source 333 via conduit 335 (both of which are schematically shown) to the pressurized fluid being supplied by pressurized fluid source 24 at a location downstream of hose 28. Those remaining components of fluid sprayer 520 which correspond to components of fluid sprayer 20 are numbered similarly.

As shown by FIG. 15, attachment 530 is similar to attachment 130 except that attachment 530 additionally comprises injection port 540 which is schematically illustrated. Injection port 540 comprises a conduit extending through tubular body 170 and fluidly coupled to passage 162. In the implementation illustrated, injection port 540 is fluidly coupled to passage 162 such that supplemental fluid supplied through conduit 335 is drawn into the fluid stream flowing through passage 162 at a desired rate. In the implementation illustrated, injection port 340 opens into passage 162 at a location such that when a supplemental attachment, the supplemental attachment 200 is connected to attachment 530, injection port 340 becomes isolated from the pressurized fluid from source 24 flowing through attachment 530 and further flowing through supplemental attachment 200. As a result, the drawing of supplemental fluid from supplemental fluid source 333 into the main pressurized stream from source 24 is automatically stopped when a supplemental attachment is attached to attachment 530. Thus, supplemental fluid is automatically provided in lower pressure applications such as when constrictor 160 service a nozzle tip and is automatically stopped in higher pressure applications, such as when a high pressure attachment, such as attachment 200, serves as the nozzle tip.

In the example implementation illustrated, injection port 540 opens into passage 162 of tubular body 170 between channel 195 and balls 186 of quick disconnect portion 166. As a result, in the absence of a supplemental attachment being connected to attachment 530, injection port 540 is in fluid communication with the empty passage 162 of tubular member 170 and is in communication with the pressurized fluid stream originating from pressurized fluid source 24 such that supplemental fluid from source 333 may be drawn into (or pumped into) the pressurized fluid stream. When a supplemental attachment, such as attachment 200, is connected to attachment 530, injection port 540 is sealed off from the pressurized fluid stream originating from source 24. As shown by FIG. 15, O-ring 194 forms a seal between injection port 540 the fluid passage of attachment 530 to the left of constrictor 160 (as seen in FIG. 15) and the inlet of the fluid passage through attachment 200. In implementations where the supplemental fluid is drawn into the fluid stream in the absence of a supplemental attachment, isolation of injection port 540 from the fluid stream will result in supplemental fluid being no longer drawn into the fluid stream. In implementations where the supplemental fluid is pumped into the fluid stream through injection port 540, sealed may be provided on opposite sides of injection port 540 to block injection port 540. For example, an additional O-ring may be provided between injection port 540 and balls 186 or a seal may be provided at a location where balls 186 and groove 204 engage one another. In other implementations, injection port 540 may open into the interior tubular member 170 at other locations.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

an attachment for a fluid sprayer, the attachment comprising:

a main flow passage;

a quick disconnect portion to facilitate connection of a supplemental attachment having a first flow constrictor, the first flow constrictor providing a first pressure drop; and a second flow constrictor located so as to be between the main flow passage and the first flow constrictor, the second flow constrictor providing a second pressure drop less than the first pressure drop, wherein the quick disconnect portion comprises:

a tubular portion being integrally formed as a single unitary body with the second flow constrictor;

a plurality of circumferentially arranged openings in the tubular portion;

balls within the openings, the balls being resiliently biased to positions in which the balls project into the tubular portion; and a collar slidable between a releasing positioned withdrawn from the balls and a retaining position in which a collar overlies the balls, the collar being resiliently biased towards the retaining position.

2. The apparatus of claim 1, wherein the second flow constriction comprises a soaper nozzle.

3. The apparatus of claim 1 further comprising the supplemental attachment comprising a high pressure nozzle releasably connected to the attachment, the quick disconnect portion providing the first flow constrictor.

4. The apparatus of claim 1 comprising an injection mechanism to facilitate injection of supplemental fluid into a main fluid stream passing through the quick disconnect portion, the injection mechanism comprising an injection port connected to an interior of the attachment.

5. The apparatus of claim 4, wherein the injection port is configured to be isolated from liquid flow through the attachment in response to the attachment receiving a high pressure nozzle attachment.

6. The apparatus of claim 5, wherein the injection port is sized and located so as to be blocked in response to the attachment receiving the high pressure nozzle.

7. The apparatus of claim 4, wherein the injection mechanism further comprises a check valve along the injection port.

8. The apparatus of claim 7, wherein the check valve is configured to open in response to the main fluid stream passing through the attachment when the quick disconnect portion is not connected to the high pressure nozzle.

9. The apparatus of claim 8, wherein the injection mechanism further comprises a venturi, wherein the injection port opens along the venturi.

10. The apparatus of claim 7, wherein the check valve is configured to close in response to fluid pressure within the main fluid passage when the high pressure nozzle is connected to the attachment and while the main fluid stream is passing through the attachment.

11. The apparatus of claim 4, wherein the injection mechanism further comprises a manually actuatable valve along the injection port to selectively open and close the injection port.

12. The apparatus of claim 1, wherein the attachment includes a threaded portion to be secured to the fluid sprayer, wherein the second flow constrictor extends between the threaded portion and the quick disconnect portion.

13. The apparatus of claim 1, wherein the second flow constrictor has an asymmetric orifice.

14. The apparatus of claim 1, further comprising the supplemental attachment which comprises a high pressure nozzle facilitating a pressure immediately upstream of the second constriction of less than 1000 PSI absent the high pressure nozzle and wherein the high pressure nozzle, when attached to the attachment, facilitates a pressure immediately upstream of the second constriction of greater than 1000 PSI.

15. An apparatus comprising:

an attachment for a fluid sprayer, the attachment comprising:

a main flow passage;

a quick disconnect portion to facilitate connection of a supplemental attachment having a first flow constrictor, the first flow constrictor providing a first pressure drop;

a second flow constrictor located so as to be between the main flow passage and the first flow constrictor, the second flow constrictor providing a second pressure drop less than the first pressure drop;

an injection mechanism to facilitate injection of supplemental fluid into a main fluid stream passing through the quick disconnect portion, the injection mechanism comprising an injection port connected to an interior of the attachment, wherein the injection port is configured to be isolated from liquid flow through the attachment in response to the attachment receiving a high pressure nozzle attachment.

16. The apparatus of claim 15, wherein the injection port is sized and located so as to be blocked in response to the attachment receiving the high pressure nozzle.

17. An apparatus comprising:

an attachment for a fluid sprayer, the attachment comprising:

a main flow passage;

a quick disconnect portion to facilitate connection of a supplemental attachment having a first flow constrictor, the first flow constrictor providing a first pressure drop; and a second flow constrictor located so as to be between the main flow passage and the first flow constrictor, the second flow constrictor providing a second pressure drop less than the first pressure drop, wherein the second flow constrictor has an asymmetric orifice.

* * * * *